US005167081A

United States Patent [19]

Loyns

[11] Patent Number: 5,167,081

[45] Date of Patent: Dec. 1, 1992

[54] GRAIN DRYER

[76] Inventor: Ronald A. Loyns, Box 295, Naicam, Saskatchewan, Canada, S0K 2Z0

[21] Appl. No.: 720,012

[22] Filed: Jun. 24, 1991

[51] Int. Cl.[5] ..... F26B 17/14

[52] U.S. Cl. ..... 34/170; 34/179

[58] Field of Search ..... 34/168, 170, 179

[56] References Cited

U.S. PATENT DOCUMENTS

| | | | |
|---|---|---|---|
| 3,824,705 | 7/1974 | Ives | 34/170 |
| 4,499,669 | 2/1985 | Haeck | 34/168 X |
| 4,869,162 | 9/1989 | Schouten | 34/168 X |

FOREIGN PATENT DOCUMENTS

| | | | |
|---|---|---|---|
| 950660 | 7/1974 | Canada . | |
| 1532356 | 7/1968 | France | 34/179 |
| 2105449 | 3/1983 | United Kingdom .. | |

*Primary Examiner*—Stephen M. Hepperle

[57] ABSTRACT

The apparatus provides a recirculating normal batch, concurrent flow, grain dryer and an alternate small batch countercurrent flow grain dryer. Hot drying air is provided by an external conventional burner and air fan. For the normal batch, the hot air is forced to a central plenum in the grain holding bin where it radiates outwardly into horizontal conduits then passes downwardly through the grain as it moves under gravity and exits at a lower lever to the atmosphere through horizontal conduits. The gravity forced flow of grain is recirculated to the bins upper area by a centrally located elevating auger. A pivotal roof portion of the hot air inlet flues when pivoted downwardly provides a countercurrent alternate path for the hot air for small batch drying. "V" plate ribs support an inverted "V" ring cone on the lower and inner cone of the bin for proper grain flow control.

22 Claims, 2 Drawing Sheets

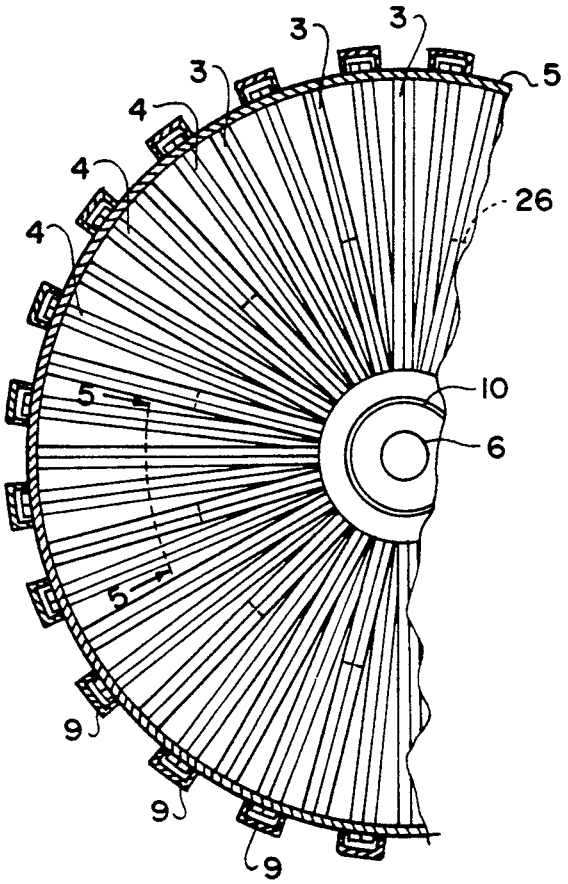
Fig. 2
Fig. 3
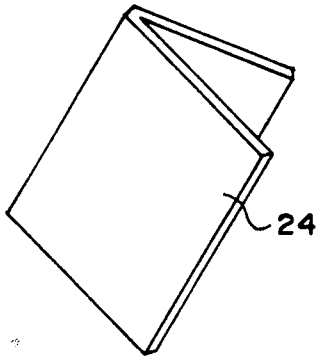
Fig. 4
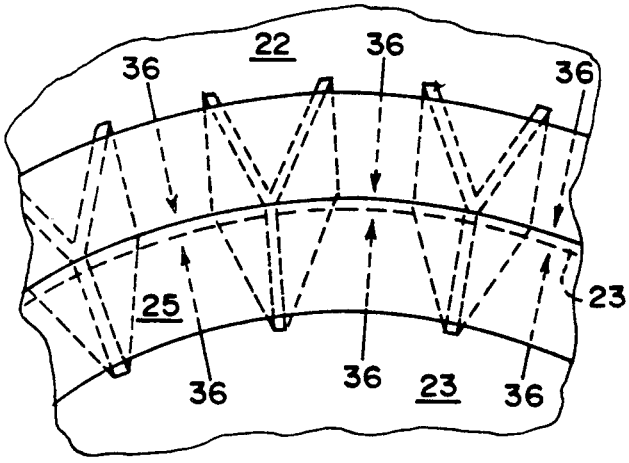
Fig. 5
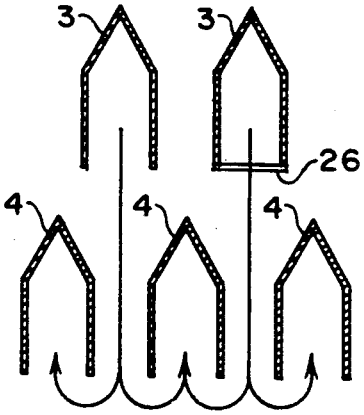
Fig. 6
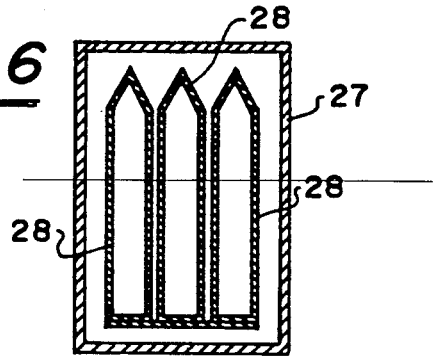

GRAIN DRYER

This application relates to grain dryers and in particular to grain dryers of the recirculating batch, concurrent or countercurrent flow type.

BACKGROUND OF INVENTION

The moisture content of freshly harvested grain is generally too high for immediate storage and must be lowered to prevent spoilage. A moisture content of 14–15% is considered acceptable for most grain elevator operators. The removal of too much moisture is, however, wasteful of drying energy and usually results in shrinkage which decreases the sale value of the grain.

There are a number of types of grain dryers in current use of which two major types are the continuous flow type and the batch type. In the continuous flow type there is generally large volumes of air at a relatively high temperature passed through the grain in a drying chamber with heat damage being minimized by a short stay of grain in the chamber. Continuous flow dryers are generally classed as concurrent flow, cross flow and counter flow depending on the relationship between the directions of grain flow and air flow through the drying chamber. Continuous flow grain drying is capable of high rates of grain processing; however, the energy efficiency of such drying in most cases is not optimum because the drying air does not become saturated with moisture because of the high flow rate of the drying air.

To obviate the problems of the continuous flow dryer the applicant has improved the batch type grain dryer. The batch type dryer has a drying bin with a quantity of grain placed therein and heated air passed therethrough until the grain is dryed. To prevent overdrying of the lower layer applicant has recirculated the grain to the upper area of the bin and has improved on the air flow and grain flow to increase the efficiency and uniformity of drying. Overdrying resulting in the cracking of the kernels and the lowering of the quality of the grain has been overcome.

Attempts at improving grain drying have been made as disclosed in Canadian Patent 950,660, in U.K. Patent application 2,105,449 and in U.S. Pat. No. 3,824,705. In regard to patent "660" there is taught a concurrent countercurrent dryer with upper transverse heated inlet ducts and lower transverse exhaust ducts. Also shown are cold inlet ducts. While applicant has heated upper ducts and lower exhaust ducts it further includes recirculating auger means, a central circular plenum hot air delivery, improved grain flow means and alternate hot air flow not found in the reference. In regard to published application "449" there is again shown an upper hot air inlet and lower hot air outlet. This is a continuous flow apparatus and is entirely different to applicants recirculating batch type with a recirculating auger, central hot air plenum and improved grain flow means. In regard to U.S. Pat. No. "705", there is shown a continuous counterflow grain drying system. Applicant has provided for a recirculating batch type with concurrent or countercurrent flow of hot air for drying.

None of the above patents either singely or combined teach or even suggest applicants new and improved grain dryer.

SUMMARY OF THE INVENTION

The apparatus of this invention provides for normal batch concurrent recirculating drying or small batch countercurrent recirculating drying. The normal batch treatment is carried out by hot air being pumped to a central plenum chamber then directed radially outwardly then downwardly with and through the gravity fed grain to the radial exhaust duct. The small batch treatment is carried out by hot air being redirected by a pivotal closing off of the plenum. The hot air is directed in a countercurrent manner against the gravity fed grain then passes to the same exhaust ducting as provided for the normal batch drying. "V" plate ribs support an inverted "V" ring cone on the lower and inner cones for proper grain flow control. In order to save time and money the drying can start in the small batch mode then when there is sufficient grain in the bin drying can then be switched over to operate in the normal batch mode.

In view of the above summarized invention it is therefore an object of this present invention to provide a drying device that will give a uniform grain flow.

It is further object of the present invention to provide a dryer that is capable of handling a normal batch or a small batch in an equally effective manner.

It is a further object of the instant invention to provide a dryer that will be effective yet not cause any damage to the grain being dried.

It is a further object of the instant invention to provide a dryer that removes the moisture uniformly throughout the batch.

It is a still further object of the present invention to provide a dryer that is easy to manufacture, operate and adjust.

These and other objects of the present invention will become readily apparent as the following description is read in conjunction with the accompanying drawings wherein like reference numerals indicate like elements throughout the several views.

BRIEF DESCRIPTION OF THE DRAWINGS

FIG. 2 is a partial plan view of the radial ducts taken along the cutting plane 2—2 in FIG. 1.

FIG. 3 is a perspective view of the support rib for the ring cone.

FIG. 4 is a partial plan section of the ring cone taken at the cutting plane 4—4 in FIG. 1 and showing the direction of downward grain flow.

FIG. 5 is a partial section of FIG. 2 taken along the cutting plane 5—5 showing the relative location of the upper and lower air ducts.

FIG. 6 is a section of the hot air inlet taken along the cutting plane 6—6 in FIG. 1.

DETAILED DESCRIPTION OF THE INVENTION

Figure 1:
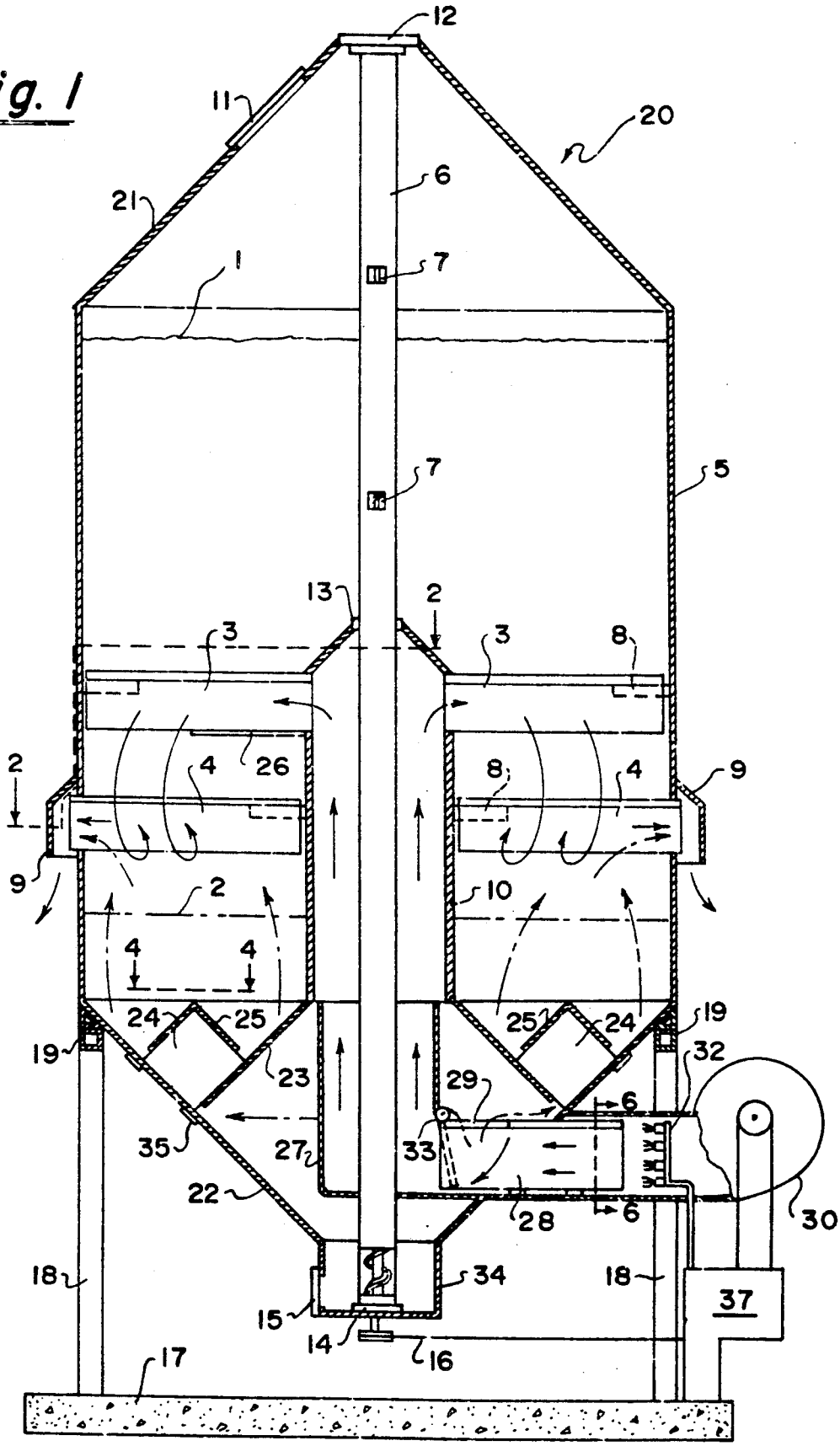
FIG. 1 is a vertical section of a circular grain holding bin indicating a recirculating normal batch system with its air flow path and a small batch system with its different air flow path.

Referring now to FIG. 1 there is shown a grain holding bin 20 with cylindrical sidewall 5 capped on the top by an upper cone 21 with a loading or inlet cover 11. The bin 20 is supported on a base 17 by support legs 18 and a compression ring 19 fixed to a lower cone 22 of the bin 20. At the lower end of the lower cone 22 is a sump 34 which provides an end bearing support 14 for the vertical recirculating auger 6 and a grain outlet or loading opening 15. Below the sump 34 is a drive 16 for the auger 6. A hot air duct 27 carries three flues 28 which are fed by a conventional burner 32 and air fan 30 both of which are controlled by a control box 37. The top or roof portion 29 of each flue 28 can be pivoted about a pivot point 33 blocking off hot air passage to the plenum 10. The pivoting is controlled manually by an external control rod not shown.

For a normal batch of wet grain as approximately indicated at level 1, or at least above the air transfer ducts 3, hot air is fed to the hot air duct 27 and on into a central plenum 10. The grain flows by gravity over air transfer ducts 3, over air outlet ducts 4, around support ribs 24 and down to the sump 34 where it is picked up by the recirculating auger 6 and augered up to an auger outlet 7 for maintaining the approximate desired level. As the grain is flowing downwardly hot air from plenum 10 passes outwardly along the transfer ducts 3. The transfer ducts 3 are disposed radially outwardly from the plenum 10 with every second transfer duct 3 having a blocking plate 26 covering approximately one half of the opening along the bottom. The hot air then passes through the grain that is flowing downwardly and picks up moisture from this grain. Laden with the moisture the hot air passes over the radially disposed exhaust ducts 4 then enters its open bottom as shown clearly in FIG. 5. Leaving the exhaust ducts 4 the hot moisture laden air is deflected by exhaust deflectors 9. The transfer ducts 3 are fixed at one end to the plenum 10 and are telescopically supported at their other end by a support 8 fastened to the cylindrical side wall 5. The exhaust ducts 4 are fixed to the cylindrical sidewall 5 and telescopically supported at their other end by a support 8 fastened to the plenum 10. The support ribs 24 are fixed to the outer cone 22 and can be reinforced by plates 35. The support ribs 24 are also fixed to and support the inner cone 23 and ring cone 25. The ring cone 25 allows grain to flow past both bottom edges of the ring and on down between the inner cone 23 and the bottom cone 22 to the sump 34. The support ribs 24 are of a "V" shape and are placed so that the apex of the "V" is angled nearest to the central auger 6. The angle of the "V" is approximately 45° and slows the draw down rate by about 60%. The spacing of the support ribs 24 is about 16 inches (40.6 cm.) apart giving a uniform flow for uniform drying.

Alternately for a small batch of wet grain as indicated at a level below the exhaust ducts such as at level 2, we again have the grain flowing downwardly past the ring cone 25 and its support ribs 24 to the sump 34. The pivotal partial flue roofs 29 are pivoted downwardly blocking off the passage along the hot air duct 27 but opening a passageway to the area between the lower cone 22 and the inner cone 23. The hot air now passes upwardly past the support ribs 24 and the ring cone 25 and on up to the exhaust ducts 4 and to the outside. This of course is a countercurrent type of drying as opposed to the concurrent type used in the normal batch drying.

Now looking at FIG. 2 there is shown the radial arrangement of the transfer ducts 3 and the exhaust ducts 4 as seen from the cutting plane 2—2 in FIG. 1. Exhaust deflectors 9 may be used and are fixed to the cylindrical sidewall 5

In FIG. 3 there is shown in perspective a support rib 24 which has a "V" shape whose included angle is approximately 45° .

In FIG. 4 there is shown several of the support ribs 24 in a plan view as shown in cutting plane 4—4 of FIG. 1. As previously stated the support ribs 24 support the ring cone 25, they are spaced about 16 inches apart, they slow the inside draw down by about 60% and are important for uniform flow and thus uniform drying. The grain flows past the support ribs 24 in two directions as is shown by the arrows 36.

Now referring to FIG. 5 there is shown in more detail the vertical and horizontal location of the transfer ducts 3 and the exhaust ducts 4. This view is a section from the cutting plane 5—5 in FIG. 2. There is clearly indicated by arrows how the hot air flows downwardly from the transfer ducts 3 to the exhaust ducts 4 from which it escapes to the outside. Also shown here is one blocking plate 26 which as previously stated blocks one half of the bottom outlet of every second transfer duct 3.

Now referring to FIG. 6 which is a section shown by the cutting plane 6—6 taken across the hot air duct 27. Three flues 28 conduct air from the fan 30 which is heated by the burner 32 along the hot air duct 27. Portions 29 of the roofs of the flues 28 closest to the central auger 6 are pivoted by an external rod (not shown) for a normal batch or small batch as previously described.

In testing the operation of the dryer 20 wheat was artificially wetted and loaded into the dryer. The burner 32 and fan 30 were started to generate hot air flow and the recirculation of the grain begun. The grain moved downwardly due to gravity where it was joined by hot air thus removing the moisture. The partially dried grain as it reached the sump 34 was recirculated by auger 6 until samplings indicated a desired moisture content. The burner was then shut off with the fan remaining operational to cool the grain. The dried grain was then removed through discharge opening 15 in the sump 34.

The drying air temperature was controlled by a modulating valve and monitored with an analog thermometer. All dryer functions were controlled manually.

Although the invention has been described with a certain degree of particularity it is understood that the present disclosure has been made only by way of example and that numerous changes in the details of construction and the combination and arrangement of parts may be resorted to without departing from the spirit and scope of the invention as hereinafter claimed.

What I claim is:

1. A grain dryer comprising in combination, a grain holding bin, a base, a compression ring fastened to said grain holding bin, support legs located between said base and said compression ring supporting the grain holding bin in an upright position, said grain holding bin being circular in cross section and having an upper end cone and a lower end cone for confining the grain in said dryer, said upper end cone having an access opening, a sump located at the apex of said lower end cone, a grain auger vertically positioned and having a bottom end supported in said sump and a top end supported in the apex of said upper end cone for recirculating the grain, auger outlets located at various elevations in said grain auger, a heat source, an air fan, a control center connected to and controlling the operation of, said heat source said air fan and said grain auger, a hot air duct connected to said heat source and mounted in said lower end cone receiving air from said air fan heated by said heat source, a plenum encircling a portion of said grain auger for receiving hot air from said hot air duct, transfer ducts radiating outwardly from said plenum to carry the hot air outwardly and downwardly, exhaust ducts radiating outwardly from said plenum to carry the heated air from said transfer ducts to the ambient atmosphere, support ribs fixed to said lower end cone and an inner cone, a ring cone supported on said support ribs for proper control of grain flow, whereby a normal batch of grain approximately filling said grain holding bin will gravitate past the transfer ducts and the exhaust ducts where the heated air picks up moisture from the grain and exhausts it to the atmosphere, the grain being recirculated by the grain auger from the sump toward the upper end cone.

2. A grain dryer as claimed in claim 1 further including a central support on said grain auger.

3. A grain dryer as claimed in claim 2 further including an outlet in said sump.

4. A grain dryer as claimed in claim 3 further including exhaust deflectors mounted on the exterior of said grain holding bin to deflect the hot air flowing from the exhaust ducts.

5. A grain dryer as claimed in claim 4 further including telescopic means supporting said transfer ducts and said exhaust ducts.

6. A grain dryer as claimed in claim 5 further including a plurality of flues in said hot air duct.

7. A grain dryer as claimed in claim 6 wherein each of said plurality of flues includes a pivotal portion 29 as a valve to enable redirecting the heated air from the hot air duct to an area under said inner cone.

8. A grain dryer as claimed in claim 7 wherein several of said transfer ducts further include a blocking plate 26 to restrict egress of hot air therefrom.

9. A grain dryer as claimed in claim 8 wherein the support ribs are in the form of a "V" plate having an included angle of approximately 45° and wherein the exhaust ducts are transversly offset from the transfer ducts.

10. A recirculating batch type columnar grain dryer comprising in combination, a grain holding body means including an inlet and an outlet, a base, support means supporting the grain holding body means on said base in a vertical position, a hot air source, hot air ducting means connected to said hot air source and to said grain holding body means to carry the hot air to the interior of said grain holding body means to pick up moisture from grain gravitating in said grain holding body means, exhaust ducts connected to said grain holding body means to accept the moisture laden hot air and transfer it to the atmosphere, vertical grain recirculating means supported by said grain holding body means, an inverted "V" ring cone, a lower portion of said grain holding body means encompassing said inverted "V" ring cone for uniform downward grain flow, supporting ribs fixedly connected to said lower portion of said grain holding body means supporting said inverted "V" ring cone, a sump mounted on the lower extremity of said grain holding body means to provide a pick up area for said vertical grain recirculating means, whereby a batch of hot air dried grain is recirculated until an acceptable moisture content is attained.

11. A combination concurrent, countercurrent recirculating batch dryer comprising grain holding body means including an inlet and an outlet, support means holding said grain holding body means in a vertical position, a hot air source, hot air ducting means connected to said hot air source and adapted to carry the hot air to the interior of said grain holding body means to enable moisture pickup from the grain by concurrent grain and hot air flow, the grain flowing under the force of gravity, exhaust duct means mounted on said grain holding body means to accept the moisture laden hot air transfer it to the atmosphere, vertical grain recirculating means having multiapertured egress means and supported by said grain holding body means, an inverted "V" ring cone means supported and encompassed by a lower portion of said grain holding body means, pivotal means in said hot air ducting means enabling a redirection of the hot air flow to said lower portion of said grain holding body means, thereby causing a grain drying hot air to be countercurrent to the downward gravity flow of the grain past said inverted "V" ring cone which is particularly useful for small batch drying.

12. A recirculating batch type columnar grain dryer as claimed in claim 10 wherein the grain holding body means is circular at a mid cross section with an uppermost portion being conical and said lower portion being conical.

13. A recirculating batch type columnar grain dryer as claimed in claim 12 wherein said hot air ducting means includes a plenum chamber circumjacent said vertical grain recirculating means.

14. A recirculating batch type columnar grain dryer as claimed in claim 13 wherein said hot air ducting means further includes transfer ducts connected to said plenum chamber and telescopically supported by a protrusion mounted on said grain holding body means and wherein several of said transfer ducts have a restricted egress for the hot air.

15. A recirculating batch type columnar grain dryer as claimed in claim 14 wherein several of said supporting ribs are formed as "V" shaped plates and wherein the included angle of the 'v' is approximately 45°.

16. A combination concurrent, countercurrent recirculating batch dryer as claimed in claim 11 wherein said hot air ducting means includes a plenum chamber circumjacent said vertical grain recirculating means and wherein said pivotal means is positioned between said hot air source and said plenum chamber.

17. A combination concurrent, countercurrent recirculating batch dryer as claimed in claim 16 wherein said hot air ducting means includes one or more flues side by side.

18. A combination concurrent, countercurrent recirculating batch dryer as claimed in claim 17 wherein said pivotal means includes a pivotally mounted roof portion of each of said flues.

19. A combination concurrent, countercurrent recirculating batch dryer as claimed in claim 18 further including an inner cone extending downwardly from said plenum chamber in said lower portion of said grain holding body means.

20. A recirculating batch type columnar grain dryer as claimed in claim 15 further including an inner cone fixed to said supporting ribs and said plenum chamber.

21. In a recirculating batch type grain dryer having a grain holding body with an inlet and an outlet, a hot air source, hot air ducting connected to said hot air source for conveying hot air to a central location in the interior of said grain holding body, radially disposed transfer ducts connected by said hot air ducting to transfer the hot air outwardly and downwardly, radially disposed exhaust ducts connected to said grain holding body to convey said hot air leaving said transfer ducts to the atmosphere, an inverted "V" ring cone below said radially disposed exhaust ducts and supported by said grain holding body for control of grain flowing in said grain holding body, vertical grain recirculating means supported at the lowest extremity of said grain holding body to recirculate the grain upwardly, whereby grain gravitating past said radially disposed transfer ducts and radially disposed exhaust ducts has moisture removed and is recirculated by said vertical grain recirculating means until a desired moisture content is achieved.

22. In a recirculating batch type grain dryer as claimed in claim 21 further including an inner cone supported on said grain holding body to cooperate with said inverted "V" ring cone for grain flow control.

* * * * *